United States Patent [19]

Lostra

[11] Patent Number: 4,779,843

[45] Date of Patent: Oct. 25, 1988

[54] JACK WITH DRAIN VALVE

[76] Inventor: John M. Lostra, 576 Elm, P.O. Box 841, Elko, Nebr. 89801

[21] Appl. No.: 91,404

[22] Filed: Aug. 31, 1987

Related U.S. Application Data

[63] Continuation-in-part of Ser. No. 861,961, May 12, 1986, abandoned.

[51] Int. Cl.[4] ..... B66F 3/24

[52] U.S. Cl. ..... 254/93 R; 91/49; 91/401

[58] Field of Search ..... 91/401, 47, 410, 431, 91/49, 424; 254/93 R

[56] References Cited

U.S. PATENT DOCUMENTS

| | | | |
|---|---|---|---|
| 3,028,096 | 4/1962 | Beggs | 91/47 |
| 3,099,940 | 8/1963 | Leduc | 91/49 |
| 4,240,620 | 12/1980 | Tunkers | 91/401 |

FOREIGN PATENT DOCUMENTS

| | | | |
|---|---|---|---|
| 1117008 | 5/1956 | France | 91/49 |
| 53-20076 | 2/1978 | Japan | 91/401 |

*Primary Examiner*—Robert C. Watson
*Attorney, Agent, or Firm*—Paul F. Horton

[57] ABSTRACT

A jack with drain valve including a housing having a first cylinder and a first piston; the first piston defining a second cylinder into which a second piston is reciprocally mounted. A drainage tube is defined by the first piston, the drainage tube extending between the second cylinder and the bottom, workpiece engaging surface of the piston. When both first and second piston engage a workpiece, hydraulic fluid may be forced through an inlet port into the first cylinder, placing pressure against both first and second pistons in their engagement with the workpiece; the drainage tube being obstructed by the second piston. Once the workpiece is moved or the jack retracted, pressure on the hydraulic fluid in the first cylinder, which may be applied by upward pressure on the first piston, forces the second piston downwardly beyond the inlet port of the drainage tube. In this manner the cylinders may be readily drained for reuse of the jack.

4 Claims, 1 Drawing Sheet

JACK WITH DRAIN VALVE

This application is a continuation in part of application Ser. No. 06/861,961 filed by the inventor on May 12, 1986, now abandoned.

BACKGROUND OF THE INVENTION

1. Field of the Invention

This invention relates in general to jacks of the piston-cylinder type and more particularly to such jacks provided with drain valves.

2. Description of the Prior Art

Piston type jacks are well known in the art. Such jacks are most often provided with an internal hydraulic fluid check valve. Of those which permit entrance of fluid into the cylinder from an external source, outward flow of the hydraulic fluid is usually prevented. A common problem with such units is that it is often desirous to deactivate the jack immediately upon removal of the workpiece to be compressed or upon retraction of the jack; and to remove fluid from the cylinder after compression to replace the piston to its original position. To remove the fluid the hydraulic valve may be removed or a manual stopcock is provided. Drain valves which are either activated or deactivated by overcoming a compressor spring, as typified by U.S. Pat. No. 3,140,722 issued to C. G. Gordon and U.S. Pat. No. 3,246,664, are generally used to bypass hydraulic fluid wen the pressure within the system exceeds a predetermined value. While such valves are acceptable for the purpose for which they are intended, such valves are not usable directly with a workpiece to maintain the integrity of the valve when directly in contact with the workpiece; to drain the fluid from the cylinder by simply compressing the piston; and then to again activate the jack by contact with the workpiece.

SUMMARY OF THE INVENTION

The present invention comprises, generally, a jack with drain valve including a cylinder-piston unit wherein the piston has a workpiece engaging surface and wherein the piston includes within itself a second cylinder and piston, the second piston also including a workpiece engaging surface and the second piston provided with a drainage tube connected between the second cylinder and atmosphere, the second piston blocking the drainage tube during use, but being forced below the drainage tube by compression of the first piston to drain the cylinders. A more thorough description may be found in the appended claims.

It is therefore a primary object of the present invention to provide a piston type jack which can be drained simply by compressing the workpiece engaging surface of the primary piston.

Another object of the present invention is to provide a piston type jack wherein the piston directly engages a workpiece, said jack provided with an drain valve in the form of a second piston contained within the first piston, the second piston also having a workpiece engaging surface.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
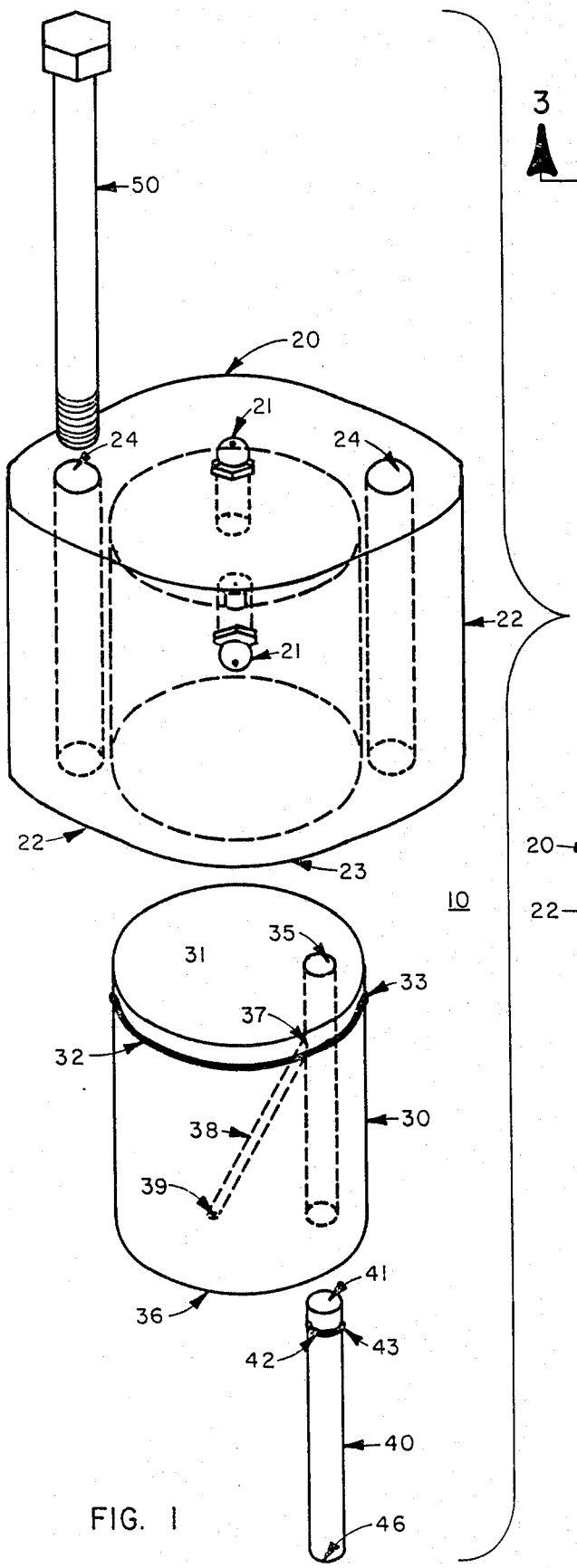
FIG. 1 is an exploded perspective view of the jack with drain valve of the present invention.
Figure 2:
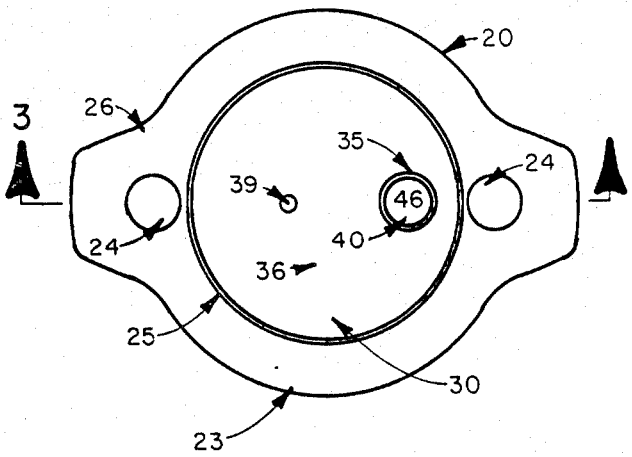
FIG. 2 is a bottom view of the invention.

Referring now to the drawings, an embodiment 10 to be preferred of a jack with drain valve made according to the present invention is disclosed. Jack 10 includes, generally, a housing 20; a first piston 30; a second piston 40; and workpiece attachment means designated by the numeral 50.

Housing 20 defines a cylinder 25 for reception of first piston 30. One or more fluid inlet ports 27 for intake of hydraulic fluid 3 into cylinder 25 are provided. The fluid inlet ports may be provided with conventional ball-in-socket check valves 21 onto which an hydraulic hose or grease gun may be engaged. Housing 20 may include a pair of side members 22, preferably integral with the main body 23 of the housing, the side members each defining an aperture 24 for receiving workpiece attachment member 50 which, in the embodiments shown is in the form of two threaded bolts, only one of which is shown; the threaded bolts operable to engage threaded apertures 4 in the workpiece. It is obvious that attachment member 50 may be either singular or plural and may be in the form of clamps and the like, depending upon the nature of the workpiece 2.

Figure 3:
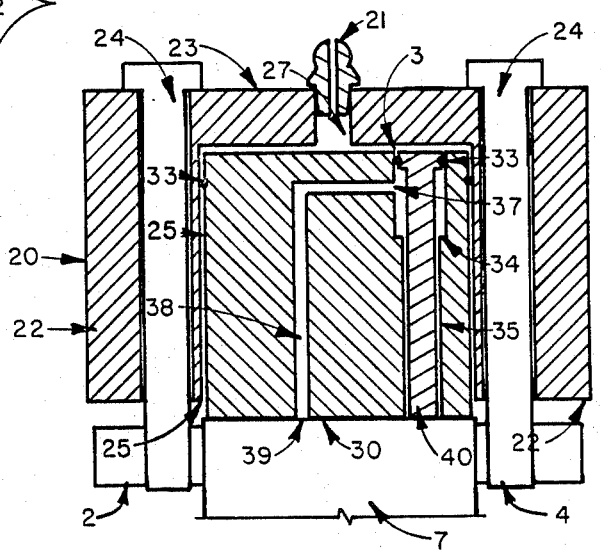
FIG. 3 is a sectional view of a second embodiment of the present invention, shown engaging a workpiece.

Reciprocally mounted within cylinder 25 of housing 20 is first piston 30. Piston 30 may include an annular groove 32 into which a rubber O-ring is seated. Piston 30 defines a second cylinder 35 for reception of a second piston 40. Also defined by piston 30 is a drainage tube 38 having an inlet port 37 in fluid communication with cylinder 35 and an outlet port 39 opening to atmosphere on the bottom, workpiece engaging surface 36 of piston 30. The top surface 31 of the piston is in engagement with fluid 3 which is injected into cylinder 25. FIG. 1 shows the drainage tube having been drilled in a straight oblique line from the bottom surface of the piston to the cylinder while FIG. 3 shows an L-shaped tube formed from two separate drillings and including a plug, not shown, in a portion of the drilled piston.

Reciprocally mounted within cylinder 35 of first piston 30 is a second piston 40. Like piston 30, the second piston is preferably provided with an annular groove 42 for seating of O-ring 43. The top surface 41 is in engagement with fluid 3 which is injected into cylinder 25 and hence into cylinder 35 which opens into the first cylinder. The opposing, bottom surface 46 of piston 40 engages the workpiece. Cylinder 35 may be enlarged at its upper end, as shown to advantage in FIG. 3, to define a circular shoulder 34 which is engaged by a likewise enlarged upper portion of piston 40 to prevent the piston from being completely displaced from the cylinder. Piston 40 obstructs inlet port 37 of drainage tube 38 when in contact with a workpiece, but may be forced below the port, thereby allowing free drainage of the fluid when not in contact with the workpiece. The piston must be of such a length that it obstructs the inlet port when in engagement with the workpiece.

For operation, and assuming the jack 10 has bottom surfaces 36 of first piston 30 and 46 of second piston 40 in contact with workpiece 2, hydraulic fluid 3 is forced through one of the check valves 21 and through inlet port 27 into cylinder 25. The fluid, which engages the top surfaces 31 and 41 of first piston 30 and second piston 40, respectively, forces both of the pistons downwardly with the workpiece engaging surfaces of the pistons in contact with the workpiece; equal pressure being applied to each of the pistons. Workpiece 2, or a movable portion thereof, for example, press fitting 7, may then be moved a selected distance with both pistons still applying pressure on the workpiece. Once the workpiece is moved away from contact with the pistons, pressure may be applied to the workpiece engaging surface of piston 30 to force piston 40 downward where the piston no longer obstructs inlet port 37 of drainage tube 38 to allow free passage of the fluid to atmosphere, to restore piston 30 to its original position. Should the pistons once again engage the workpiece, the jack once again becomes activated. In the embodiment shown in FIG. 3, shoulder 34 of cylinder 35 prevents the piston from being completely removed from the cylinder. To drain fluid from the cylinders, only a slight pressure need be exerted on the workpiece engaging surface of cylinder 30, while allowing piston 40 to move downwardly for unobstructed flow of fluid 3 through the drainage tube.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A jack with drain valve comprising:

a housing provided with workpiece attachment means;

a first cylinder defined by said housing, said cylinder provided with at least one fluid inlet port;

a first piston mounted for reciprocal movement within said first cylinder, said piston provided with a fluid engaging surface at one end and a workpiece engaging surface on the opposing end;

a second cylinder defined by said first piston;

a second piston mounted for reciprocal movement within said second cylinder, said second piston provided with a fluid engaging surface at one end and a workpiece engaging surface on the opposing end; and a fluid drainage tube defined by said first piston, said drainage tube having an inlet port in fluid communication with said second cylinder and an outlet port on the workpiece engaging surface of said first piston for releasing fluid from said first cylinder to atmosphere when said inlet port of said drainage tube is unobstructed by said second piston.

2. The apparatus as described in claim 1 wherein each fluid inlet port of said first cylinder is provided with a check valve.

3. The apparatus as described in claim 1 wherein each of said pistons includes an annular groove and an O-ring for seating in the groove.

4. The apparatus as described in claim 1 wherein said second piston is of such a length that said piston obstructs the inlet port of said drainage tube when the workpiece engaging surface of said piston is flush with the workpiece engaging surface of said first piston to prevent drainage of fluid from said first cylinder when said workpiece surfaces of each of said pistons is in contact with a workpiece.

* * * * *